US011111000B2

(12) United States Patent
Song

(10) Patent No.: US 11,111,000 B2
(45) Date of Patent: Sep. 7, 2021

(54) FULL-FACE DIVING MASK

(71) Applicant: LUOYANG FLUENT SPORTS PRODUCT CO., LTD., Luoyang (CN)

(72) Inventor: Kui Song, Luoyang (CN)

(73) Assignee: LUOYANG FLUENT SPORTS PRODUCT CO., LTD., Luoyang (CN)

( * ) Notice: Subject to any disclaimer, the term of this patent is extended or adjusted under 35 U.S.C. 154(b) by 454 days.

(21) Appl. No.: 16/141,986

(22) Filed: Sep. 26, 2018

(65) Prior Publication Data

US 2020/0094928 A1 Mar. 26, 2020

(51) Int. Cl.
*B63C 11/16* (2006.01)
*B63C 11/12* (2006.01)

(52) U.S. Cl.
CPC ..... *B63C 11/16* (2013.01); *B63C 11/12* (2013.01); *B63C 2011/121* (2013.01)

(58) Field of Classification Search
CPC .... B63C 11/12; B63C 11/16; B63C 2011/121
USPC ..... 405/186; 128/201.23, 201.24, 201.27
See application file for complete search history.

(56) References Cited

U.S. PATENT DOCUMENTS

| | | | | |
|---|---|---|---|---|
| 9,104,024 | B2 * | 8/2015 | Partridge | G02B 27/017 |
| 9,864,258 | B1 * | 1/2018 | McVicker | B63C 11/22 |
| 10,661,866 | B1 * | 5/2020 | McVicker | B63C 11/02 |
| 10,676,168 | B1 * | 6/2020 | Wentworth | B63C 11/12 |
| 2015/0177597 | A1 * | 6/2015 | Harrison | B32B 27/36 396/419 |
| 2015/0282548 | A1 * | 10/2015 | Tulley | A42B 3/04 2/422 |
| 2015/0309396 | A1 * | 10/2015 | Rohrer | G03B 17/561 224/181 |
| 2016/0297505 | A1 * | 10/2016 | Caprice | B63C 11/16 |
| 2017/0096204 | A1 * | 4/2017 | Cucchia | B63C 11/16 |
| 2017/0274969 | A1 * | 9/2017 | Lin | B63C 11/12 |
| 2017/0334531 | A1 * | 11/2017 | Shiue | B63C 11/16 |
| 2018/0065719 | A1 * | 3/2018 | Liao | B63C 11/16 |
| 2018/0134352 | A1 * | 5/2018 | Armani | B63C 11/26 |
| 2018/0208281 | A1 * | 7/2018 | Wung | B63C 11/12 |
| 2018/0297676 | A1 * | 10/2018 | Zheng | B63C 11/16 |
| 2018/0319471 | A1 * | 11/2018 | Thomas | B63C 11/205 |
| 2019/0118917 | A1 * | 4/2019 | Xiao | B63C 11/16 |
| 2019/0224506 | A1 * | 7/2019 | Palmieri | F16K 15/144 |
| 2019/0329853 | A1 * | 10/2019 | Zheng | B63C 11/16 |
| 2019/0359302 | A1 * | 11/2019 | Shiue | F16M 11/2021 |

(Continued)

FOREIGN PATENT DOCUMENTS

| | | | | |
|---|---|---|---|---|
| CN | 204659997 | * | 9/2015 | B63C 11/16 |
| DE | 202019102161 | U1 * | 7/2019 | G03B 17/08 |
| EP | 3517424 | A1 * | 7/2019 | B63C 11/16 |

(Continued)

*Primary Examiner* — Frederick L Lagman
(74) *Attorney, Agent, or Firm* — Leong C. Lei

(57) ABSTRACT

A full-face diving mask includes a full-face mask body, an intake tube, and a detachable display screen. The full-face mask body includes an outer frame, a soft rubber mask part, and a hard lens mask part. The display screen is detachably mounted to the lower end of the full-face mask body, which not only makes the diver's view more comfortable when diving underwater but also facilitates adjustment. Moreover, it is convenient to replace the display screen, which improves the flexibility of using the full-face diving mask.

6 Claims, 4 Drawing Sheets

(56) References Cited

U.S. PATENT DOCUMENTS

| | | | | |
|---|---|---|---|---|
| 2020/0031441 | A1* | 1/2020 | YiHong | B63C 11/16 |
| 2020/0064632 | A1* | 2/2020 | Partridge | G02B 27/0176 |

FOREIGN PATENT DOCUMENTS

| | | | | |
|---|---|---|---|---|
| EP | 3517808 | A1 * | 7/2019 | F16K 15/144 |
| WO | WO 2015170013 | A1 * | 11/2015 | B63C 11/16 |
| WO | WO-2019053577 | A1 * | 3/2019 | G03B 17/08 |

* cited by examiner

FULL-FACE DIVING MASK

BACKGROUND OF THE INVENTION

1. Field of the Invention

The present invention relates to a diving apparatus, and more particularly to a full-face diving mask with a detachable display screen.

2. Description of the Prior Art

With the demand for various sports, diving has become one of the emerging sports loved by more and more people. When diving, people would like to see the scenery underwater. Therefore, it is possible to wear a full-face diving mask for breathing and watching underwater scenery. This full-face diving mask usually has a display screen for recording or viewing the underwater scenery. The display screen is generally fixed to the top of the full-face diving mask, and is integrally connected with an intake tube above the full-face diving mask. There are two kinds of defects in this design. 1. The display screen is located above the full-face diving mask, which affects the visual view of the diver and is not easy to adjust the display screen. 2. The display screen is connected in a fixed manner and cannot be disassembled, which brings inconvenience to the use of the full-face diving mask because some diving activities do not require a display screen. If the display screen is damaged, it cannot be removed and replaced, which increases the cost of diving. Accordingly, the inventor of the present invention has devoted himself based on his many years of practical experiences to solve these problems.

SUMMARY OF THE INVENTION

In view of the drawbacks of the prior art, the primary object of the present invention is to provide a full-face diving mask with a detachable display screen. The display screen is detachably connected to a full-face mask body to facilitate the removal and replacement of the display screen, allowing the display screen to be removed when the display screen is not required and improving the flexibility of the diving mask.

In order to achieve the above object, the present invention adopts the following technical solutions.

A full-face diving mask comprises a full-face mask body, an intake tube, and a detachable display screen. The full-face mask body includes an outer frame, a soft rubber mask part, and a hard lens mask part. The soft rubber mask part is mounted to a rear side of the outer frame to form a cavity matching a human face. The hard lens mask part is mounted to a front side of the outer frame. The intake tube is connected to an upper end of the full-face mask body and communicates with the cavity. A lower end of the full-face mask body is provided with a first connecting portion. The display screen is provided with a second connecting portion. The first connecting portion and the second connecting portion are detachably connected.

Preferably, the second connecting portion includes a base and a support rod integrally connected to the base for connecting the display screen. A bottom of the base is provided with an arcuate cavity. Two inner side walls of the arcuate cavity are provided with a pair of slide grooves. The first connecting portion includes an arcuate block matching the arcuate cavity and sliders disposed on two side walls of the arcuate block. The arcuate block is detachably engaged in the arcuate cavity. The sliders are detachably engaged in the slide grooves.

Preferably, the support rod of the second connecting portion includes a plurality of support pieces parallel to each other, and the plurality of support pieces are connected between the base and the display screen.

Preferably, a lower end of the outer frame is split. The first connecting portion includes a left half and a right half. The left half and the right half correspond to each other. The left half and the right half are provided with connecting holes for mounting a screw to connect the left half and the right half.

Preferably, the intake tube is detachably connected to the upper end of the full-face mask body.

Preferably, two sides of an interior of the cavity are provided with one-way air inlet valves respectively communicating with the intake tube.

Preferably, two sides of the full-face mask body are provided with one-way air outlet valves, respectively. The one-way air outlet valves communicate with a bottom of the cavity.

The invention has obvious advantages and beneficial effects compared with the prior art, in particular, it can be known from the above technical solutions. The full-face diving mask is composed of the full-face mask body, the intake tube, and the display screen. The display screen is detachably mounted to the lower end of the full-face mask body, which not only makes the diver's view more comfortable when diving underwater but also facilitates adjustment. The display screen is detachably connected to the full-face mask body to facilitate the removal and replacement of the display screen, allowing the display screen to be removed when the display screen is not required and improving the flexibility of the diving mask.

Embodiments of the present invention will now be described, by way of example only, with reference to the accompanying drawings.

DETAILED DESCRIPTION OF THE PREFERRED EMBODIMENTS

Figure 1:
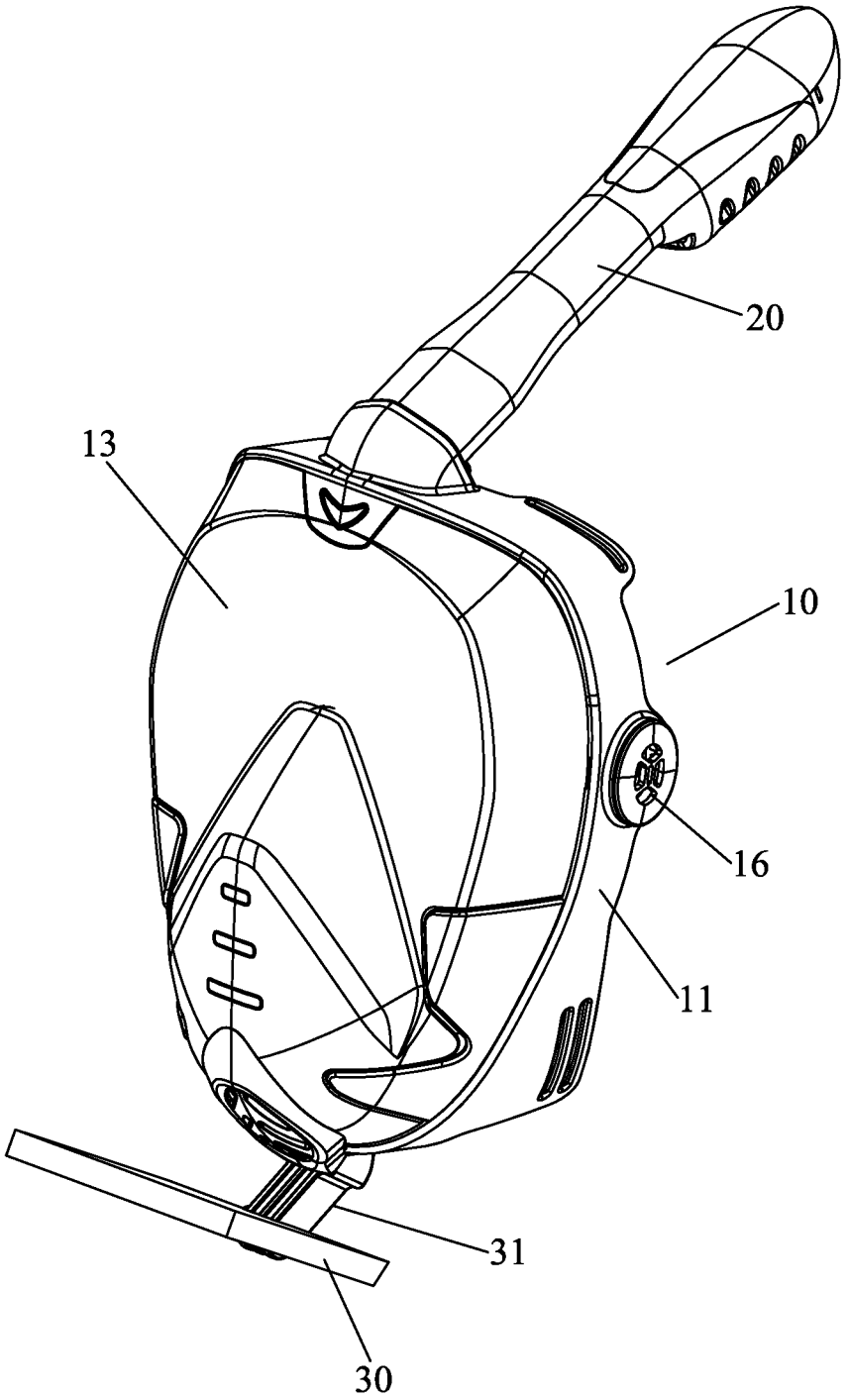
FIG. 1 is a perspective view of the full-face diving mask of the present invention.
Figure 2:
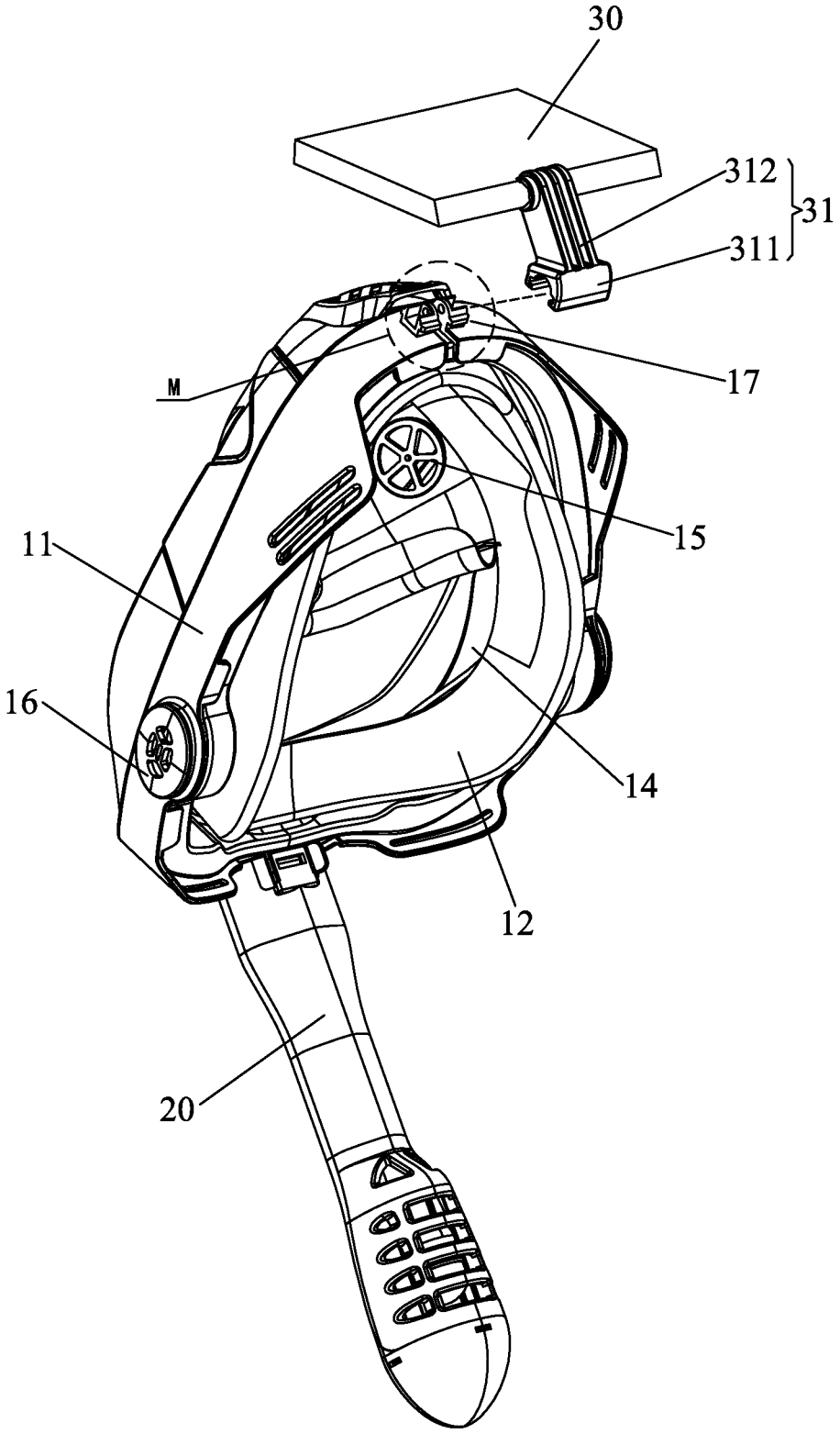
FIG. 2 is a perspective view showing that the display screen and the full-face mask body of the present invention are separated.
Figure 3:
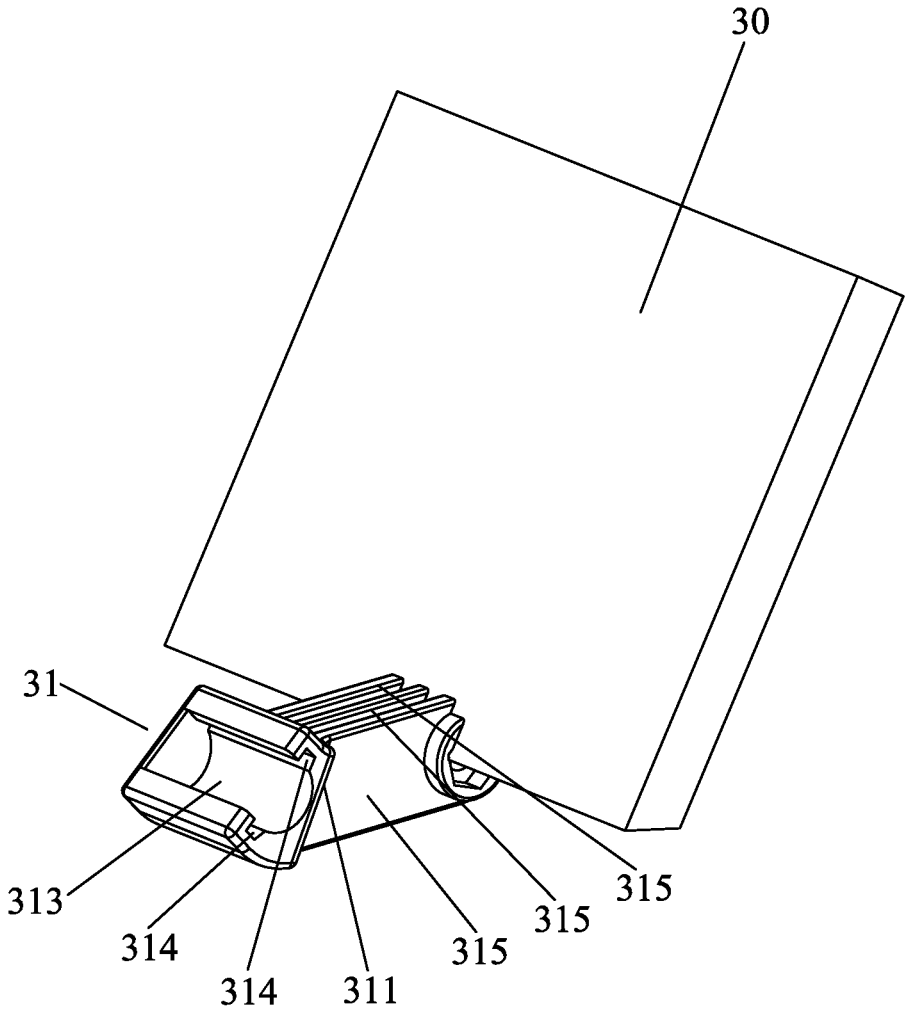
FIG. 3 is a perspective view of the display screen and the second connecting portion of the present invention.
Figure 4:
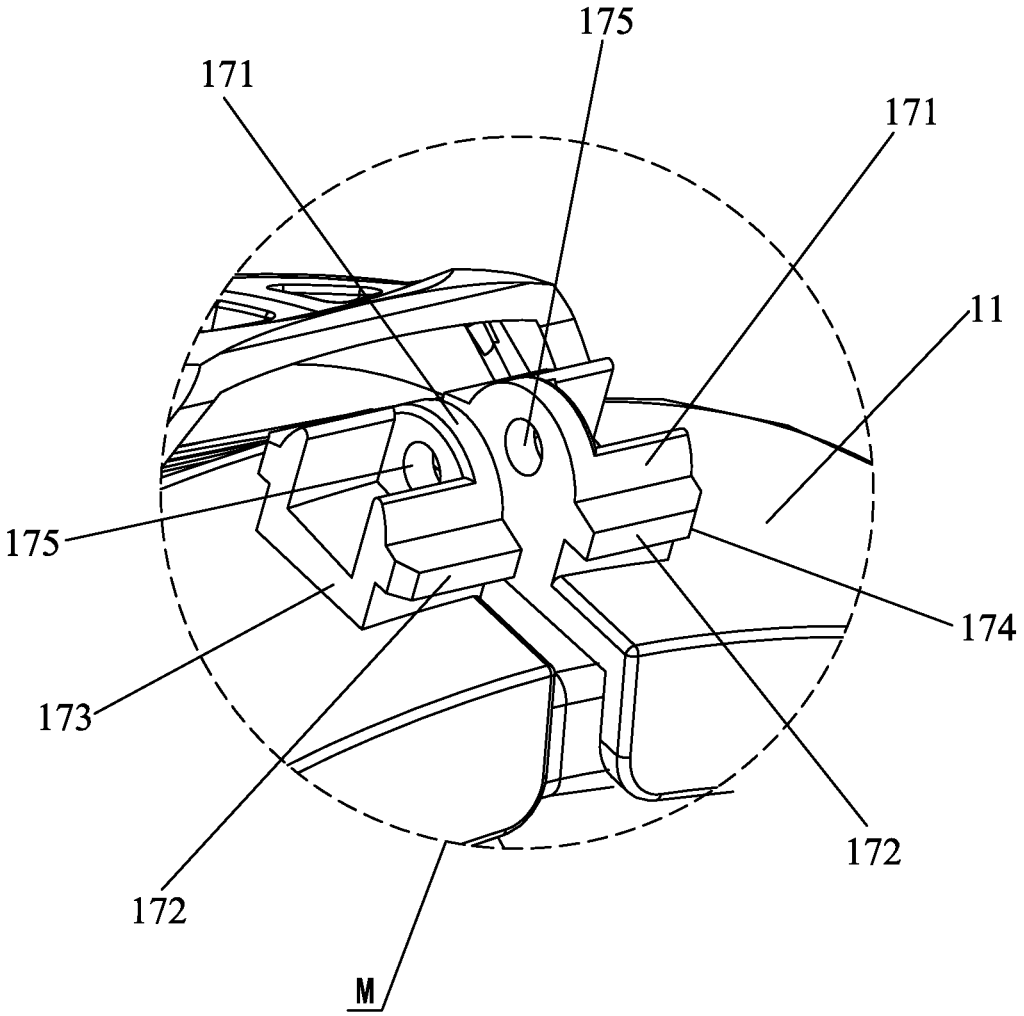
FIG. 4 is an enlarged view of circle M of FIG. 2.

The present invention, as shown in FIGS. 1 to 4, discloses a full-face diving mask, comprising a full-face mask body 10, an intake tube 20, and a detachable display screen 30.

The full-face mask body 10 includes an outer frame 11, a soft rubber mask part 12, and a hard lens mask part 13. The soft rubber mask part 12 is mounted to a rear side of the outer frame 11 to form a cavity 14 matching a human face. The hard lens mask part 13 is mounted to a front side of the outer frame 11. The intake tube 20 is detachably connected to an upper end of the full-face mask body 10 and communicates with the cavity 14. Two sides of the interior of the cavity 14 are provided with one-way air inlet valves 15 respectively communicating with the intake tube 20. Two sides of the full-face mask body 10 are provided with one-way air outlet valves 16, respectively. The two one-way air outlet valves 16 communicate with the bottom of the cavity 14, respectively. The one-way air outlet valves 16 are disposed at the two sides of the full-face mask body 10 to shorten the exhalation path and reduce the breathing pressure of the diver. A lower end of the full-face mask body 10 is provided with a first connecting portion 17. The display screen 30 is provided with a second connecting portion 31. The first connecting portion 17 and the second connecting portion 31 are detachably connected.

The second connecting portion 31 includes a base 311 and a support rod 312 integrally connected to the base 311 for connecting the display screen 30. The bottom of the base 311 is provided with an arcuate cavity 313. Two inner side walls of the arcuate cavity 313 are provided with a pair of slide grooves 314. The support rod 312 includes a plurality of support pieces 315 parallel to each other. The plurality of support pieces 315 are connected between the base 311 and the display screen 30. The first connecting portion 17 includes an arcuate block 171 matching the arcuate cavity 313 and sliders 172 disposed on two side walls of the arcuate block 171. The arcuate block 171 is detachably engaged in the arcuate cavity 313. The sliders 172 are detachably engaged in the slide grooves 314.

Further, the lower end of the outer frame 11 is split. The first connecting portion 17 includes a left half 173 and a right half 174. The left half 173 and the right half 174 correspond to each other. The left half 173 and the right half 174 are provided with connecting holes 175 for mounting a screw to connect the left half 173 and the right half 174.

The feature of the present invention is described below. The full-face diving mask is composed of the full-face mask body, the intake tube, and the display screen. The display screen is detachably mounted to the lower end of the full-face mask body, which not only makes the diver's view more comfortable when diving underwater but also facilitates adjustment. The display screen is detachably connected to the full-face mask body to facilitate the removal and replacement of the display screen, allowing the display screen to be removed when the display screen is not required and improving the flexibility of the diving mask.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A full-face diving mask, comprising a full-face mask body, an intake tube and a detachable display screen, the full-face mask body including an outer frame, a soft rubber mask part and a hard lens mask part, the soft rubber mask part being mounted to a rear side of the outer frame to form a cavity matching a human face, the hard lens mask part being mounted to a front side of the outer frame; the intake tube being connected to an upper end of the full-face mask body and communicating with the cavity; a lower end of the full-face mask body being provided with a first connecting portion, the display screen being provided with a second connecting portion, the first connecting portion and the second connecting portion being detachably connected, wherein the second connecting portion includes a base and a support rod integrally connected to the base for connecting the display screen, a bottom of the base is provided with an arcuate cavity, two inner side walls of the arcuate cavity are provided with a pair of slide grooves; the first connecting portion includes an arcuate block matching the arcuate cavity and sliders disposed on two side walls of the arcuate block, the arcuate block is detachably engaged in the arcuate cavity, and the sliders are detachably engaged in the slide grooves.

2. The full-face diving mask as claimed in claim 1, wherein the support rod of the second connecting portion includes a plurality of support pieces parallel to each other, and the plurality of support pieces are connected between the base and the display screen.

3. The full-face diving mask as claimed in claim 1, wherein a lower end of the outer frame is split, the first connecting portion includes a left half and a right half, the left half and the right half correspond to each other, the left half and the right half are provided with connecting holes for mounting a screw to connect the left half and the right half.

4. The full-face diving mask as claimed in claim 1, wherein the intake tube is detachably connected to the upper end of the full-face mask body.

5. The full-face diving mask as claimed in claim 1, wherein two sides of an interior of the cavity are provided with one-way air inlet valves respectively communicating with the intake tube.

6. The full-face diving mask as claimed in claim 1, wherein two sides of the full-face mask body are provided with one-way air outlet valves respectively, and the one-way air outlet valves communicate with a bottom of the cavity.

* * * * *